US007568768B1

(12) United States Patent
Tsai

(10) Patent No.: US 7,568,768 B1
(45) Date of Patent: Aug. 4, 2009

(54) CHAIR HAVING ELASTIC CORDS

(75) Inventor: Chin-Wen Tsai, Ho Hsing Village (TW)

(73) Assignee: Chueng Shine Co., Ltd., Chia Yi Hsien (TW)

( * ) Notice: Subject to any disclaimer, the term of this patent is extended or adjusted under 35 U.S.C. 154(b) by 0 days.

(21) Appl. No.: 12/173,194

(22) Filed: Jul. 15, 2008

(51) Int. Cl.
*A47C 7/02* (2006.01)

(52) U.S. Cl. ..... 297/452.63; 297/452.56; 24/265 C

(58) Field of Classification Search ..... 297/452.63, 297/452.56; 160/392, 393, DIG. 15; 24/300, 24/301, 265 C, 265 R
See application file for complete search history.

(56) References Cited

U.S. PATENT DOCUMENTS 6,056,367 A * 5/2000 Hsiao ..... 297/452.63
6,074,013 A * 6/2000 Hsiao ..... 297/440.1
7,226,130 B2 * 6/2007 Tubergen et al. .... 297/452.63 X
7,334,845 B2 * 2/2008 Peterson et al. ..... 297/452.63

* cited by examiner

*Primary Examiner*—Anthony D Barfield
(74) *Attorney, Agent, or Firm*—Alan Kamrath; Kamrath & Associates PA

(57) ABSTRACT

A chair includes at least one support frame having two opposite side rails, a plurality of connectors mounted in each of the side rails of the support frame, and a plurality of elastic cords each mounted between the side rails of the support frame and each having two opposite ends each attached to one of the connectors. Each of the side rails of the support frame has a hollow inside provided with a slideway and has a side provided with a guide slot. Thus, each of the connectors is fully hidden in the slideway and the guide slot of each of the two rails of the support frame so that each of the connectors will not be exposed outwardly from the support frame to enhance the outer appearance and safety of the chair.

17 Claims, 10 Drawing Sheets

CHAIR HAVING ELASTIC CORDS

BACKGROUND OF THE INVENTION

1. Field of the Invention

The present invention relates to a chair and, more particularly, to a chair having elastic cords.

2. Description of the Related Art

A conventional chair 50 in accordance with the prior art shown in FIG. 20 comprises at least one support frame 60 having two opposite side rails 64, a plurality of connectors 70 mounted on each of the two side rails 64 of the support frame 60 by a plurality of locking screws 90, and a plurality of elastic cords 80 each mounted between the two side rails 64 of the support frame 60 and each having two opposite ends 82 each attached to a respective one of the connectors 70. However, the connectors 70 and the locking screws 90 protrude outwardly from the two side rails 64 of the support frame 60, thereby decreasing the outer appearance and safety of the chair. In addition, the connectors 70 and the locking screws 90 protrude outwardly from the support frame 60, thereby easily causing an inconvenience to a user seated on the chair. Further, the connectors 70 are locked by the locking screws 90 so that the connectors 70 are easily worn out or broken during a long-term utilization, thereby causing danger to the user.

BRIEF SUMMARY OF THE INVENTION

In accordance with the present invention, there is provided a chair, comprising at least one support frame having two opposite side rails, a plurality of connectors mounted in each of the two side rails of the support frame, and a plurality of elastic cords each mounted between the two side rails of the support frame and each having two opposite ends each attached to a respective one of the connectors. Each of the two side rails of the support frame has a hollow inside provided with a slideway to allow insertion of each of the connectors. Each of the two side rails of the support frame has a side provided with a guide slot connected to the slideway to allow insertion of each of the connectors and to guide movement of each of the connectors. The guide slot of each of the two side rails of the support frame has a width smaller than that of the slideway.

The primary objective of the present invention is to provide a chair having an outstanding outer appearance.

Another objective of the present invention is to provide a chair that is operated safely.

A further objective of the present invention is to provide a chair, wherein each of the connectors is fully hidden in the slideway and the guide slot of each of the two side rails of the support frame so that each of the connectors will not be exposed outwardly from the support frame to enhance the outer appearance and safety of the chair.

A further objective of the present invention is to provide a chair, wherein the guide slot of each of the two side rails of the support frame has a width smaller than that of the slideway so that each of the connectors is received in the slideway of each of the two side rails of the support frame and limited in the guide slot of each of the two side rails of the support frame to prevent each of the connectors from being detached from each of the two side rails of the support frame.

A further objective of the present invention is to provide a chair, wherein each of the connectors is provided with two opposite fixing ribs each secured in the retaining groove of each of the two side rails of the support frame, so that each of the connectors is positioned in each of the two side rails of the support frame exactly and stably.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
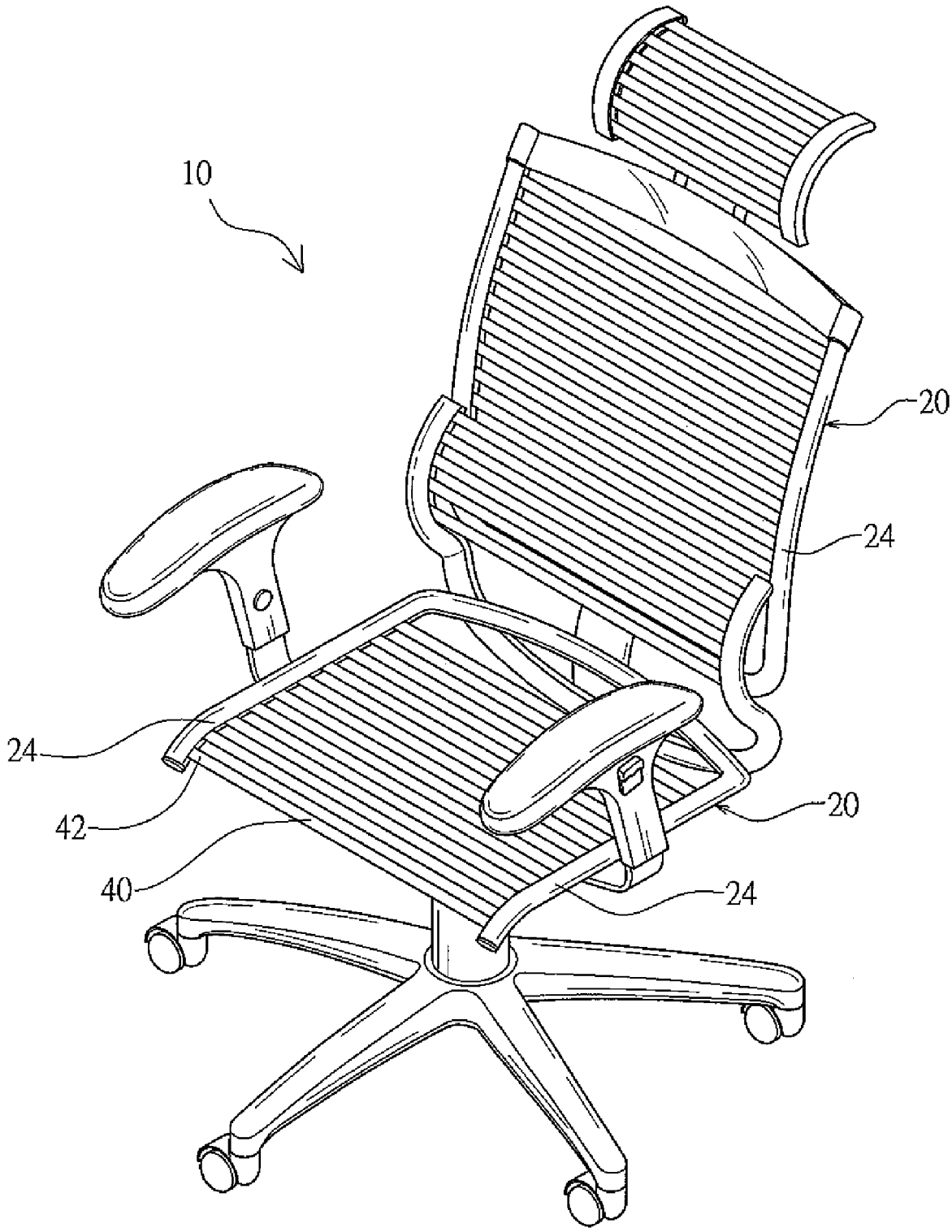
FIG. 1 is a perspective view of a chair in accordance with the preferred embodiment of the present invention.
Figure 2:
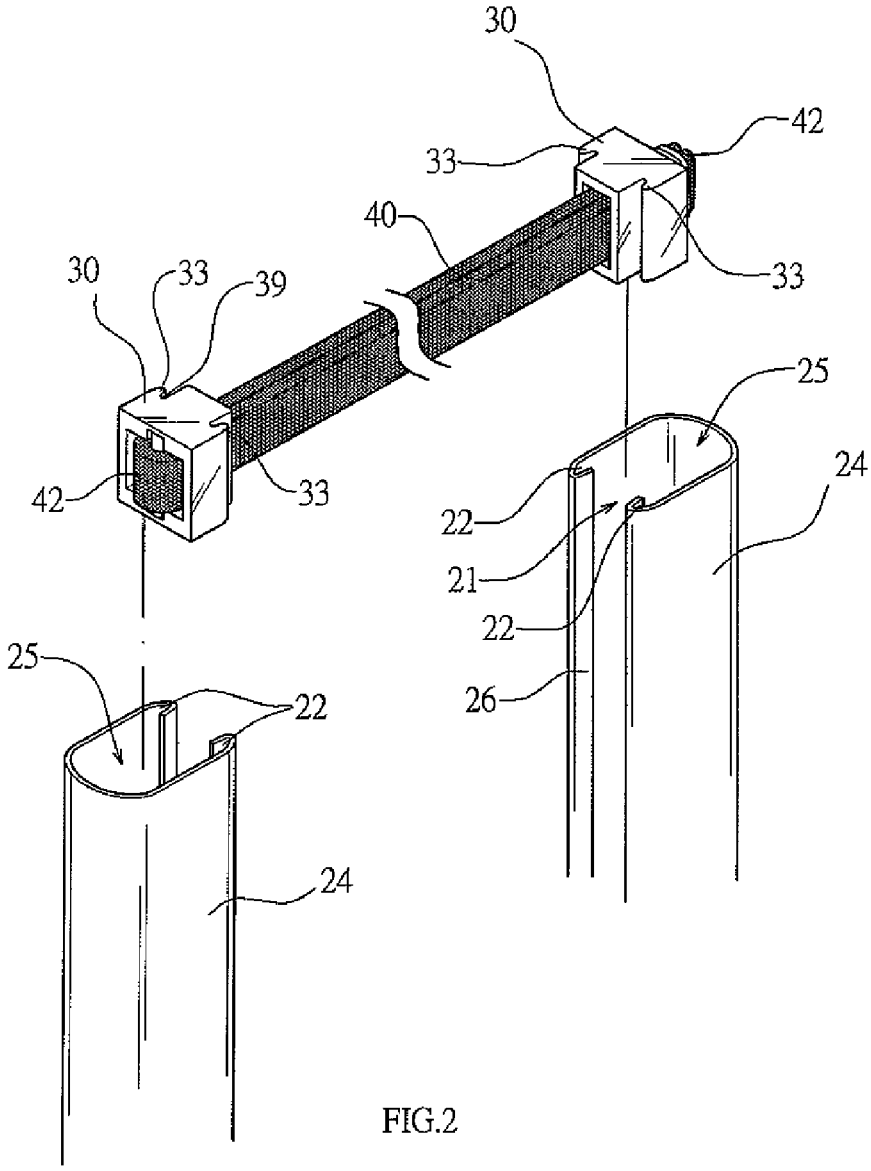
FIG. 2 is a partially exploded perspective view of the chair as shown in FIG. 1.
Figure 3:
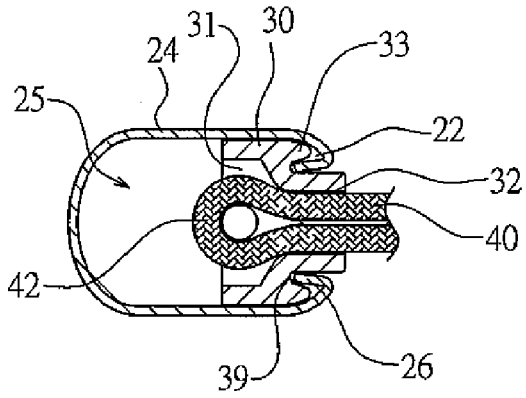
FIG. 3 is a top cross-sectional assembly view of the chair as shown in FIG. 2.
Figure 4:
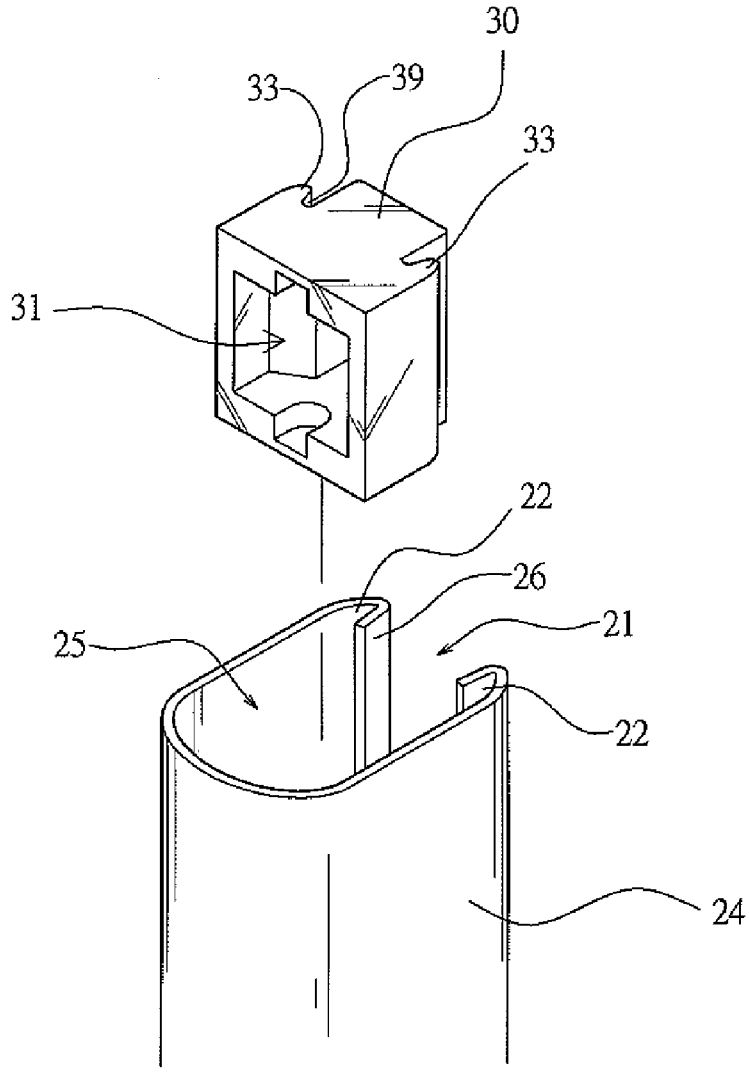
FIG. 4 is a partially exploded perspective view of the chair as shown in FIG. 1.
Figure 5:
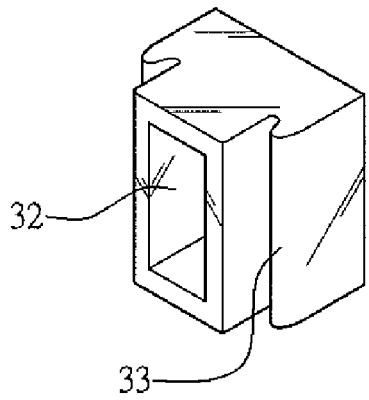
FIG. 5 is a perspective view of a connector of the chair as shown in FIG. 4.

Referring to the drawings and initially to FIGS. 1-5, a chair 10 in accordance with the preferred embodiment of the present invention comprises at least one support frame 20 having two opposite side rails 24, a plurality of connectors 30 mounted in each of the two side rails 24 of the support frame 20, and a plurality of elastic cords 40 each mounted between the two side rails 24 of the support frame 20 and each having two opposite ends 42 each attached to a respective one of the connectors 30.

Each of the two side rails 24 of the support frame 20 has a hollow inside provided with a slideway 25 to allow insertion of each of the connectors 30. Each of the two side rails 24 of the support frame 20 has a substantially U-shaped cross-sectional profile. Each of the two side rails 24 of the support frame 20 has a side provided with a guide slot 21 connected to the slideway 25 to allow insertion of each of the connectors 30 and to guide movement of each of the connectors 30. The guide slot 21 of each of the two side rails 24 of the support frame 20 has a width smaller than that of the slideway 25 and has two opposite sides each provided with a retaining groove 22 connected to the slideway 25. Each of the two side rails 24 of the support frame 20 has two opposite distal ends each provided with a bent limit flange 26 to define the retaining groove 22. The limit flange 26 of each of the two side rails 24 of the support frame 20 extends inwardly toward the slideway 25.

Each of the connectors 30 is slidably inserted into the slideway 25 of each of the two side rails 24 of the support frame 20 and limited in the guide slot 21 of each of the two side rails 24 of the support frame 20. Each of the connectors 30 is fully hidden in the slideway 25 and the guide slot 21 of each of the two side rails 24 of the support frame 20. Each of the connectors 30 has a block shape and is provided with two opposite fixing ribs 33 each secured in the retaining groove 22 of each of the two side rails 24 of the support frame 20. Each of the two fixing ribs 33 of each of the connectors 30 is provided with a fixing recess 39 for mounting the limit flange 26 of each of the two side rails 24 of the support frame 20. Each of the connectors 30 has an inner wall having a first end provided with at least one entrance 32 to allow passage of a respective one of the elastic cords 40 and to limit one of the two opposite ends 42 of the respective elastic cord 40 and a second end provided with at least one receiving chamber 31 connected to the entrance 32 to receive the one of the two opposite ends 42 of the respective elastic cord 40. The receiving chamber 31 of each of the connectors 30 is connected between the slideway 25 and the entrance 32 and has a width greater than that of the entrance 32.

In assembly, each of the two opposite ends 42 of each of the elastic cords 40 is attached to a respective one of the connectors 30. Then, each of the connectors 30 is inserted into the slideway 25 of each of the two side rails 24 of the support frame 20 and limited in the guide slot 21 of each of the two side rails 24 of the support frame 20 so that each of the elastic cords 40 is mounted between the two side rails 24 of the support frame 20 by the connectors 30.

Accordingly, each of the connectors 30 is fully hidden in the slideway 25 and the guide slot 21 of each of the two side rails 24 of the support frame 20 so that each of the connectors 30 will not be exposed outwardly from the support frame 20 to enhance the outer appearance and safety of the chair. In addition, the guide slot 21 of each of the two side rails 24 of the support frame 20 has a width smaller than that of the slideway 25 so that each of the connectors 30 is received in the slideway 25 of each of the two side rails 24 of the support frame 20 and limited in the guide slot 21 of each of the two side rails 24 of the support frame 20 to prevent each of the connectors 30 from being detached from each of the two side rails 24 of the support frame 20. Further, each of the connectors 30 is provided with two opposite fixing ribs 33 each secured in the retaining groove 22 of each of the two side rails 24 of the support frame 20, so that each of the connectors 30 is positioned in each of the two side rails 24 of the support frame 20 exactly and stably.

Figure 6:
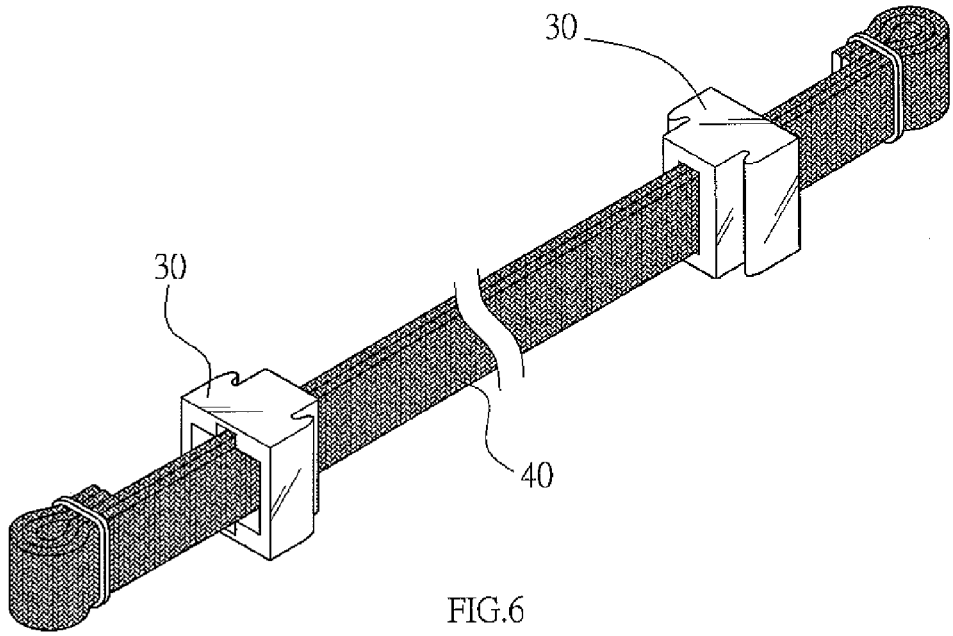
FIG. 6 is a partially perspective view of a chair in accordance with another preferred embodiment of the present invention.

Referring to FIG. 6, each of the elastic cords 40 has multiple layers.

Figure 7:
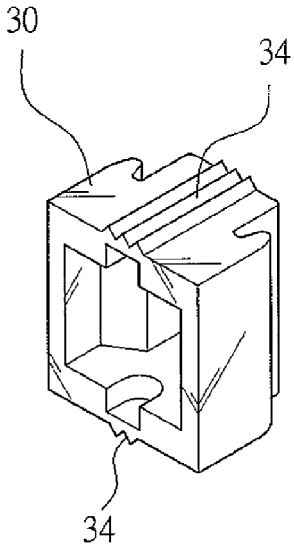
FIG. 7 is a perspective view of a connector of a chair in accordance with another preferred embodiment of the present invention.
Figure 8:
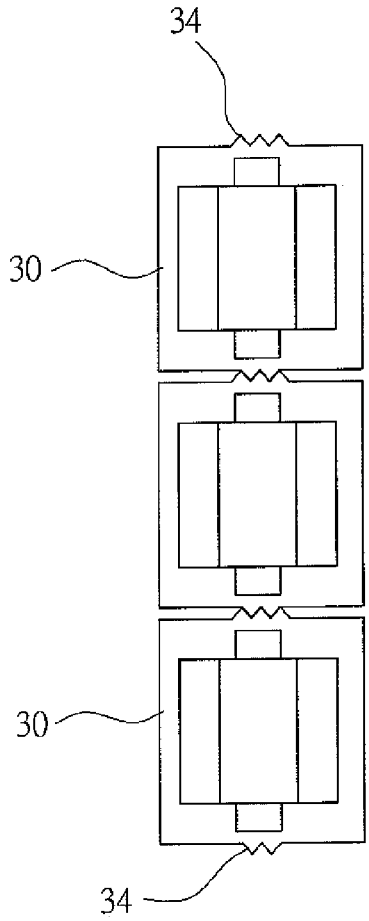
FIG. 8 is a front cross-sectional assembly view the connectors of the chair as shown in FIG. 7.

Referring to FIGS. 7 and 8, each of the connectors 30 is provided with two opposite serrated engaging portions 34, so that the connectors 30 are combined together by the engaging portions 34.

Figure 9:
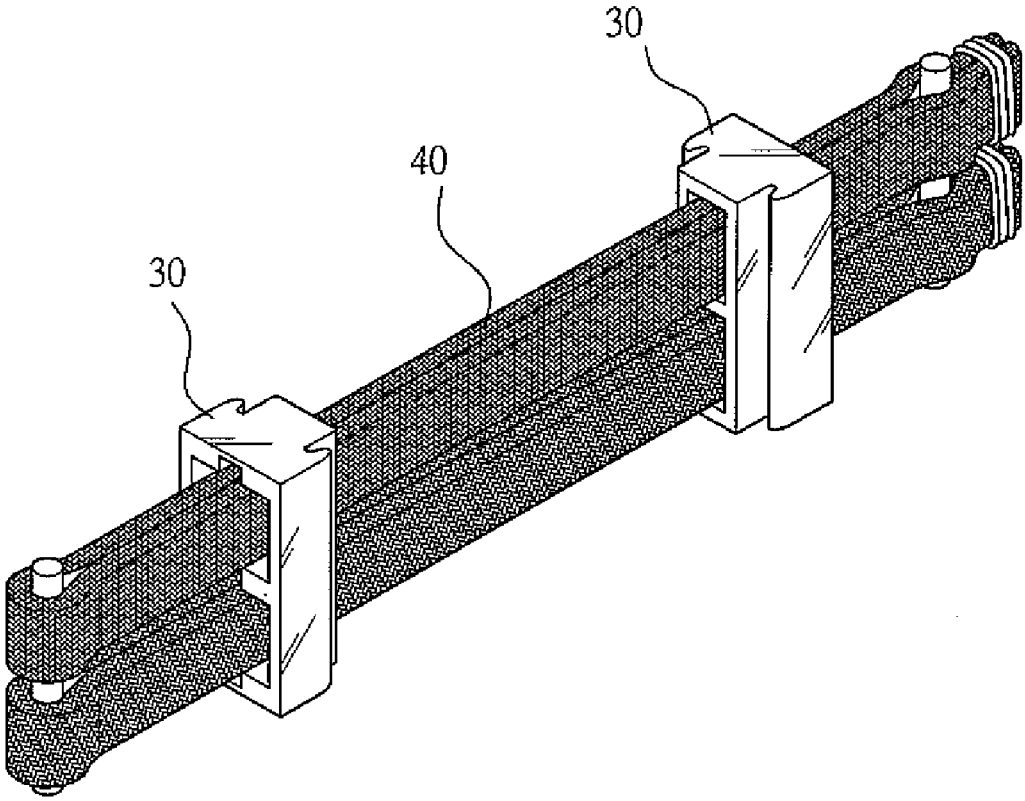
FIG. 9 is a partially perspective view of a chair in accordance with another preferred embodiment of the present invention.
Figure 10:
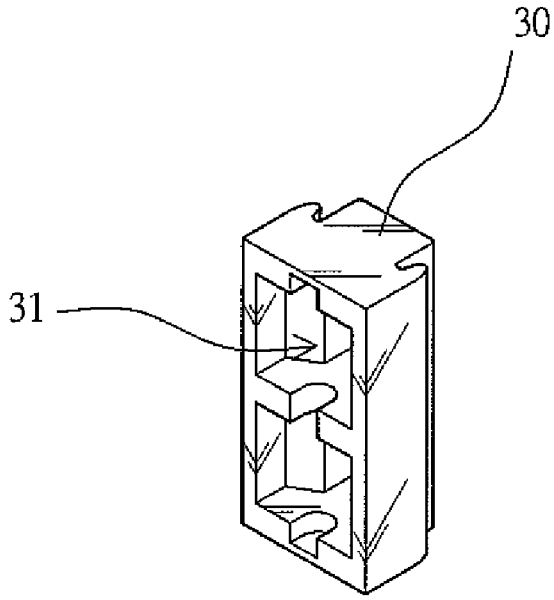
FIG. 10 is a perspective view of a connector of the chair as shown in FIG. 9.
Figure 11:
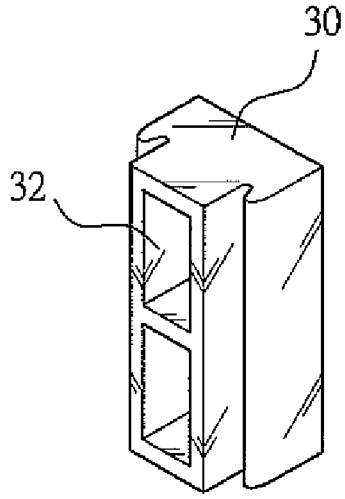
FIG. 11 is another perspective view of the connector of the chair as shown in FIG. 10.
Figure 12:
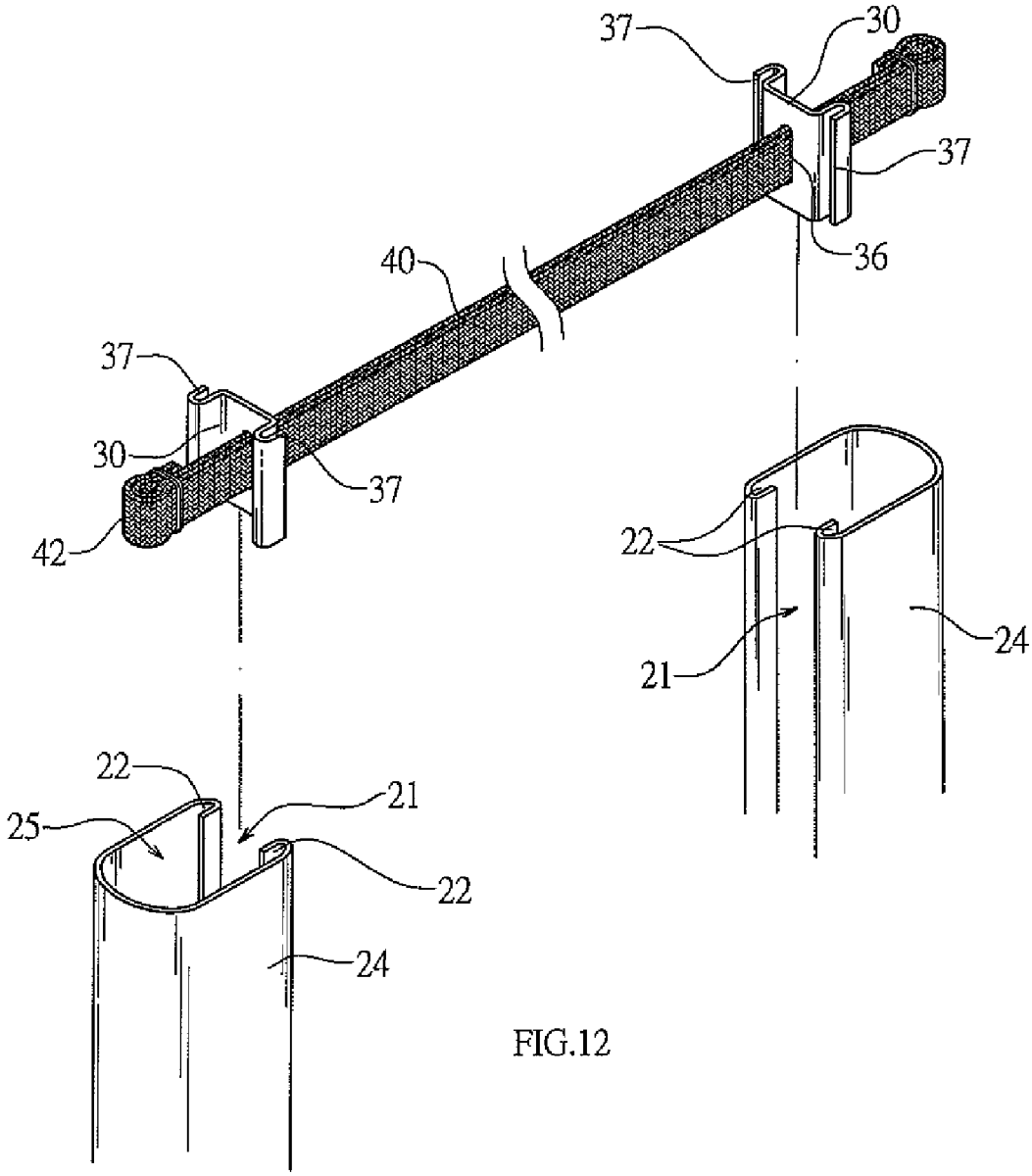
FIG. 12 is a partially exploded perspective view of a chair in accordance with another preferred embodiment of the present invention.
Figure 13:
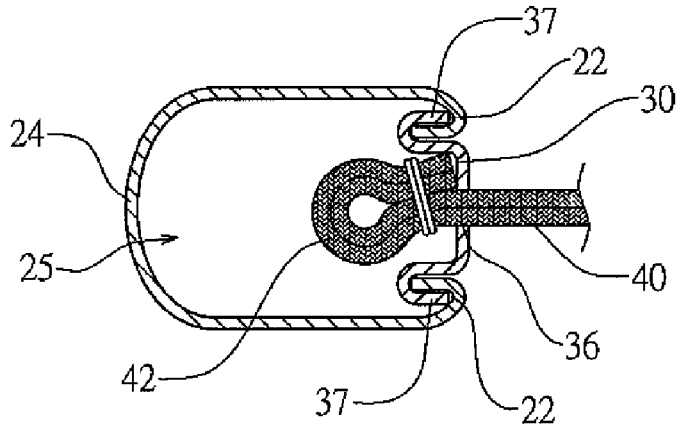
FIG. 13 is a top cross-sectional assembly view of the chair as shown in FIG. 12.
Figure 14:
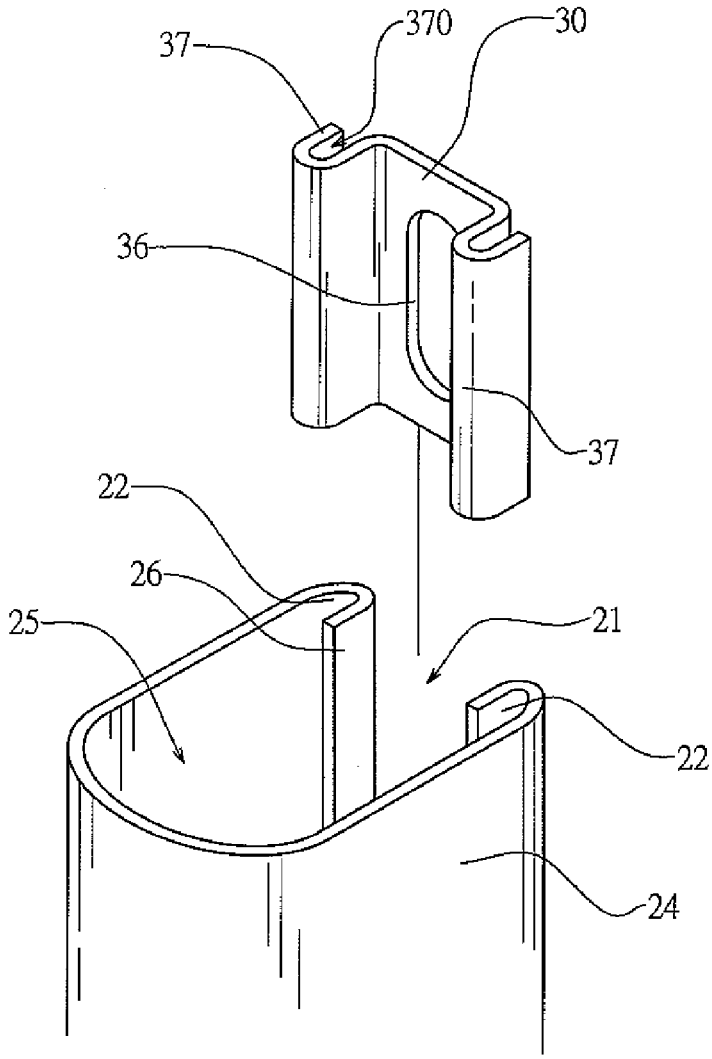
FIG. 14 is a partially exploded perspective view of a chair in accordance with another preferred embodiment of the present invention.
Figure 15:
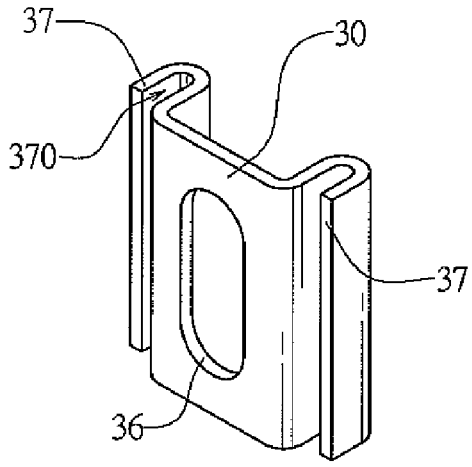
FIG. 15 is a perspective view of a connector of the chair as shown in FIG. 14.

Referring to FIGS. 9-11, each of the connectors 30 has an inner wall having a first end provided with two entrances 32 each allowing passage of a respective one of the elastic cords 40 and a second end provided with two receiving chambers 31 each connected to a respective one of the two entrances 32 and each receiving one of the two opposite ends 42 of the respective elastic cord 40.

Referring to FIGS. 12-15, each of the connectors 30 has a sheet plate shape and is provided with two opposite fixing ribs 37 each secured in the retaining groove 22 of each of the two side rails 24 of the support frame 20. Each of the two fixing ribs 37 of each of the connectors 30 is provided with a fixing recess 370 for mounting the limit flange 26 of each of the two side rails 24 of the support frame 20. Each of the connectors 30 has a mediate portion provided with an elongated slot 36 located between the two fixing ribs 37 to allow passage of a respective one of the elastic cords 40 and to limit one of the two opposite ends 42 of the respective elastic cord 40. The elongated slot 36 of each of the connectors 30 is connected to the slideway 25 of each of the two side rails 24 of the support frame 20.

Figure 16:
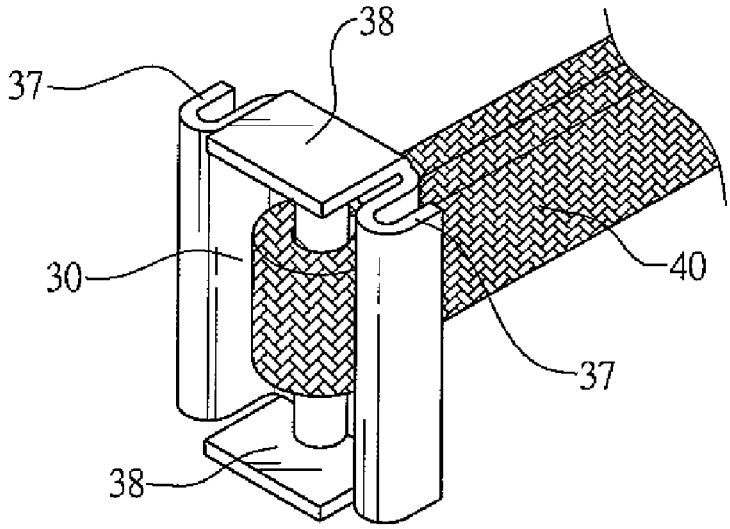
FIG. 16 is a partially perspective view of a chair in accordance with another preferred embodiment of the present invention.
Figure 17:
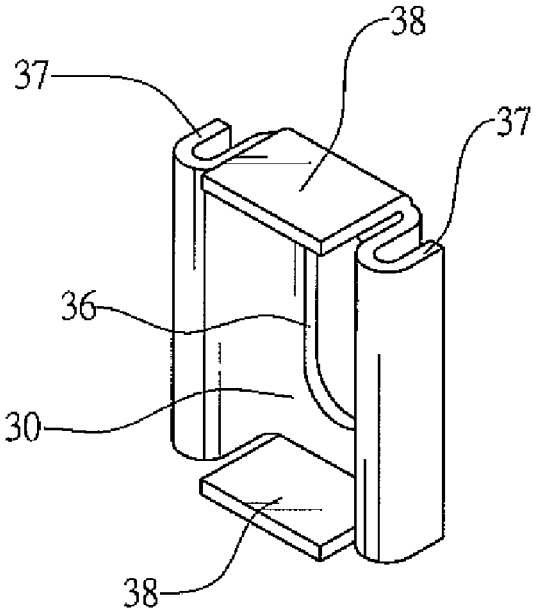
FIG. 17 is a perspective view of a connector of the chair as shown in FIG. 16.
Figure 18:
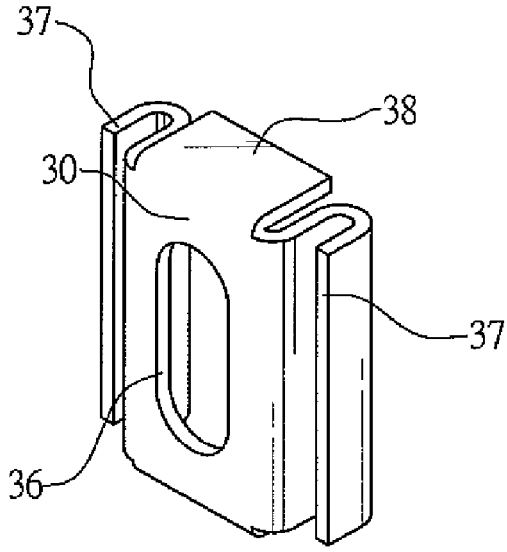
FIG. 18 is another perspective view of the connector of the chair as shown in FIG. 17.

Referring to FIGS. 16-18, each of the connectors 30 is provided with two opposite limit wings 38 surrounding the elongated slot 36 and located between the two fixing ribs 37 to prevent the respective elastic cord 40 from slipping. In addition, the elongated slot 36 is surrounded by the two fixing ribs 37 and the two limit wings 38.

Figure 19:
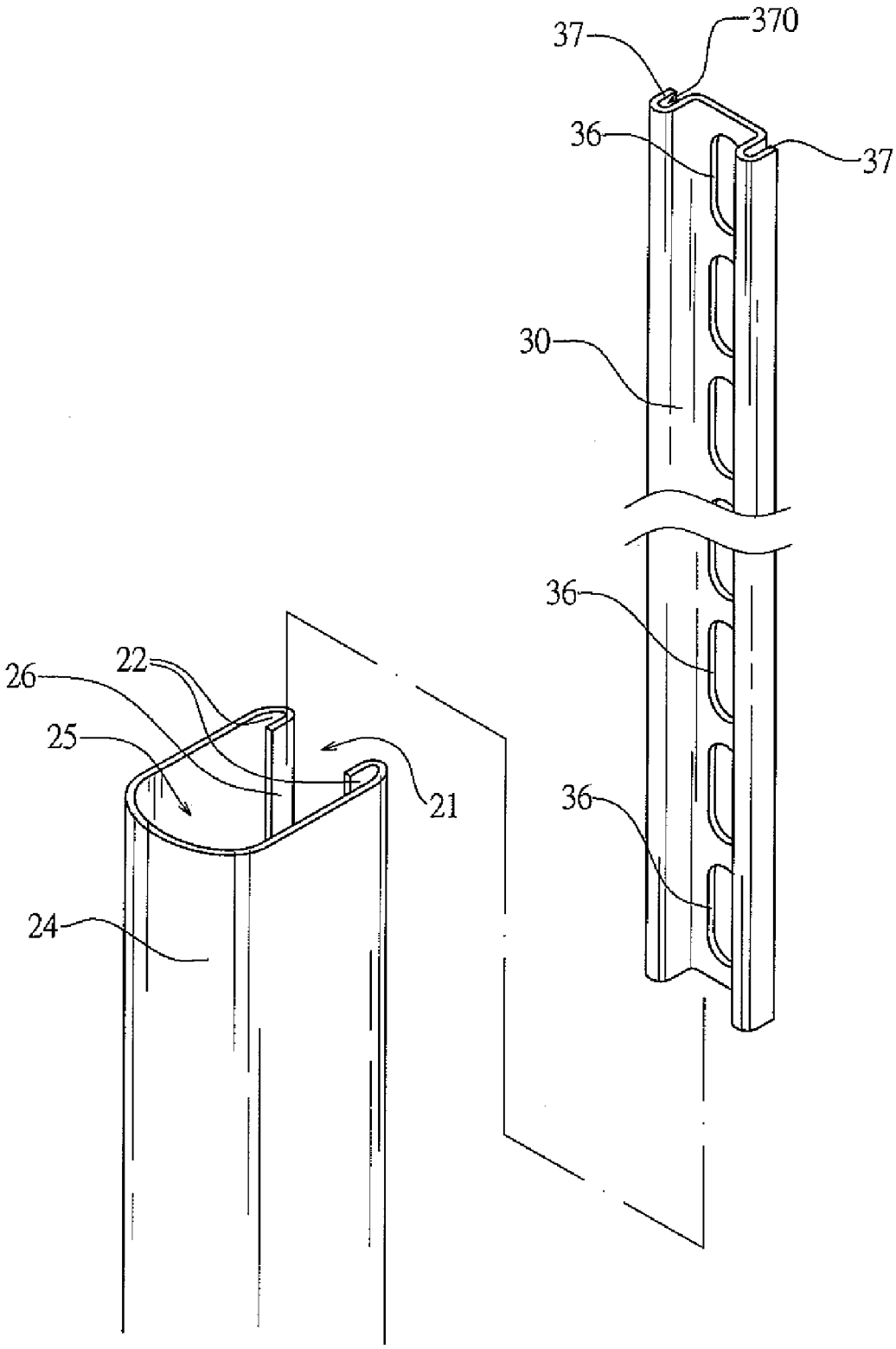
FIG. 19 is a partially exploded perspective view of a chair in accordance with another preferred embodiment of the present invention.
Figure 20:
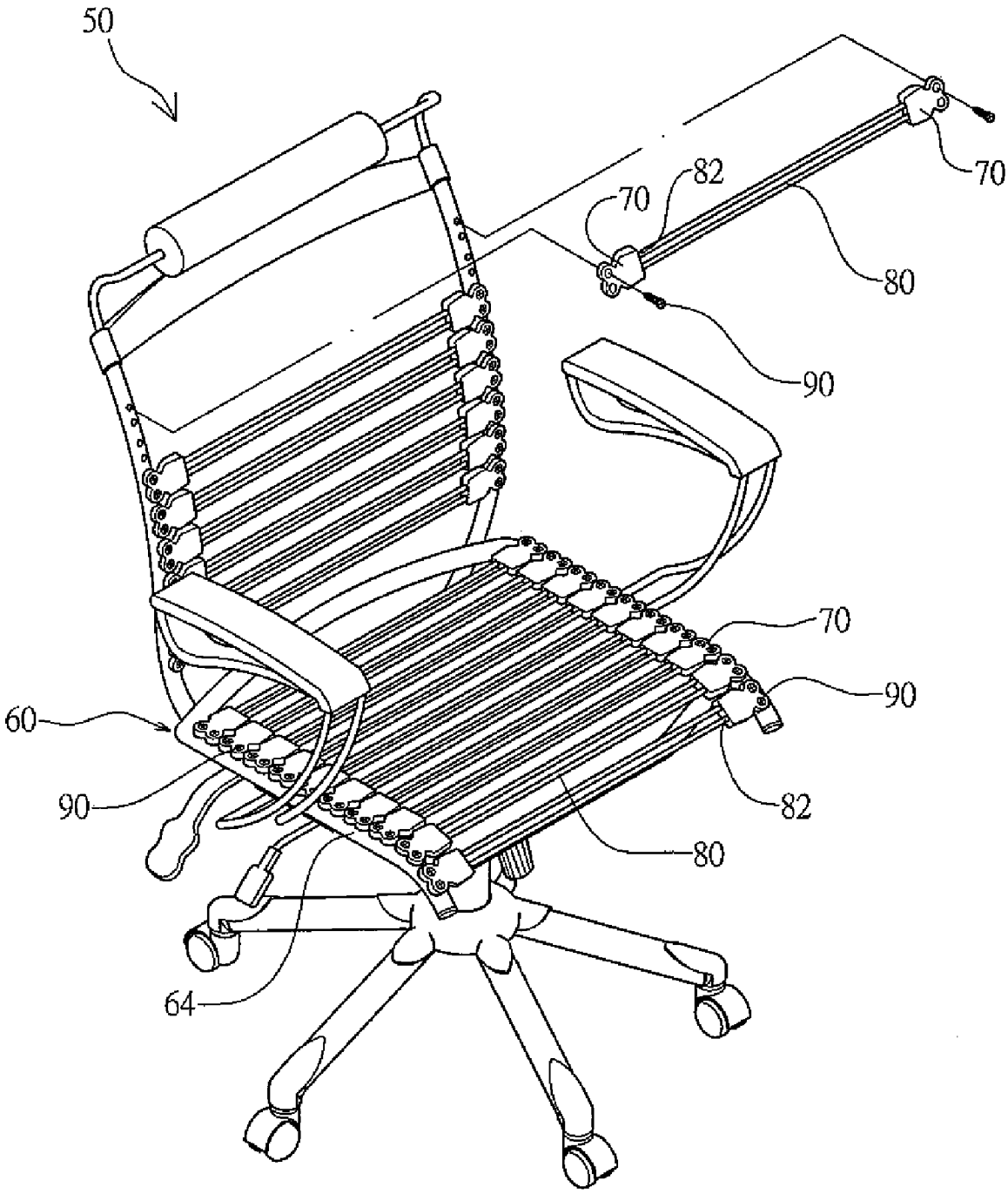
FIG.20 PRIOR ART
FIG. 20 is a partially exploded perspective view of a conventional chair in accordance with the prior art.

Referring to FIG. 19 with reference to FIGS. 1-6, the chair comprises at least one support frame 20 having two opposite side rails 24, a connector 30 mounted in each of the two side rails 24 of the support frame 20, and a plurality of elastic cords 40 each mounted between the two side rails 24 of the support frame 20 and each having two opposite ends 42 each attached to the connector 30 in a respective one of the two side rails 24 of the support frame 20. The connector 30 has an elongate sheet plate shape and is provided with two opposite fixing ribs 37 each secured in the retaining groove 22 of each of the two side rails 24 of the support frame 20. Each of the two fixing ribs 37 of the connector 30 is provided with a fixing recess 370 for mounting the limit flange 26 of each of the two side rails 24 of the support frame 20. The connector 30 has a mediate portion provided with a plurality of elongated slots 36 located between the two fixing ribs 37 to allow passage of the elastic cords 40 and to limit one of the two opposite ends 42 of the elastic cords 40.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A chair, comprising:

at least one support frame having two opposite side rails;

a plurality of connectors mounted in each of the two side rails of the support frame;

a plurality of elastic cords each mounted between the two side rails of the support frame and each having two opposite ends each attached to a respective one of the connectors;

wherein each of the two side rails of the support frame has a hollow inside provided with a slideway to allow insertion of each of the connectors;

each of the two side rails of the support frame has a side provided with a guide slot connected to the slideway to allow insertion of each of the connectors and to guide movement of each of the connectors;

the guide slot of each of the two side rails of the support frame has a width smaller than that of the slideway;

the guide slot of each of the two side rails of the support frame has two opposite sides each provided with a retaining groove connected to the slideway;

each of the connectors is provided with two opposite fixing ribs each secured in the retaining groove of each of the two side rails of the support frame.

2. The chair in accordance with claim 1, wherein each of the connectors is slidably inserted into the slideway of each of the two side rails of the support frame and limited in the guide slot of each of the two side rails of the support frame.

3. The chair in accordance with claim 1, wherein each of the connectors is fully hidden in the slideway and the guide slot of each of the two side rails of the support frame.

4. The chair in accordance with claim 1, wherein each of the connectors has an inner wall having a first end provided with at least one entrance to allow passage of a respective one of the elastic cords and to limit one of the two opposite ends of the respective elastic cord and a second end provided with at least one receiving chamber connected to the entrance to receive the one of the two opposite ends of the respective elastic cord.

5. The chair in accordance with claim 4, wherein each of the connectors has a block shape.

6. The chair in accordance with claim 4, wherein the receiving chamber of each of the connectors is connected between the slideway and the entrance and has a width greater than that of the entrance.

7. The chair in accordance with claim 1, wherein each of the connectors has a mediate portion provided with an elongated slot located between the two fixing ribs to allow passage of a respective one of the elastic cords and to limit one of the two opposite ends of the respective elastic cord.

8. The chair in accordance with claim 7, wherein each of the connectors is provided with two opposite limit wings surrounding the elongated slot and located between the two fixing ribs to prevent the respective elastic cord from slipping.

9. The chair in accordance with claim 8, wherein the elongated slot of each of the connectors is connected to the slideway of each of the two side rails of the support frame;

the elongated slot is surrounded by the two fixing ribs and the two limit wings.

10. The chair in accordance with claim 7, wherein each of the connectors has a sheet plate shape.

11. The chair in accordance with claim 1, wherein each of the two side rails of the support frame has a substantially U-shaped cross-sectional profile.

12. The chair in accordance with claim 1, wherein each of the two side rails of the support frame has two opposite distal ends each provided with a bent limit flange to define the retaining groove;

each of the two fixing ribs of each of the connectors is provided with a fixing recess for mounting the limit flange of each of the two side rails of the support frame.

13. The chair in accordance with claim 12, wherein the limit flange of each of the two side rails of the support frame extends inwardly toward the slideway.

14. The chair in accordance with claim 1, wherein each of the connectors has an inner wall having a first end provided with two entrances each allowing passage of a respective one of the elastic cords and a second end provided with two receiving chambers each connected to a respective one of the two entrances and each receiving one of the two opposite ends of the respective elastic cord.

15. A chair, comprising:

at least one support frame having two opposite side rails;

a plurality of connectors mounted in each of the two side rails of the support frame;

a plurality of elastic cords each mounted between the two side rails of the support frame and each having two opposite ends each attached to a respective one of the connectors;

wherein each of the connectors is provided with two opposite serrated engaging portions;

the connectors are combined together by the engaging portions.

16. A chair, comprising:

at least one support frame having two opposite side rails;

a connector mounted in each of the two side rails of the support frame;

a plurality of elastic cords each mounted between the two side rails of the support frame and each having two opposite ends each attached to the connector in a respective one of the two side rails of the support frame;

wherein each of the two side rails of the support frame has a hollow inside provided with a slideway to allow insertion of each of the connectors;

each of the two side rails of the support frame has a side provided with a guide slot connected to the slideway to allow insertion of each of the connectors and to guide movement of each of the connectors;

the guide slot of each of the two side rails of the support frame has a width smaller than that of the slideway;

the guide slot of each of the two side rails of the support frame has two opposite sides each provided with a retaining groove connected to the slideway;

the connector is provided with two opposite fixing ribs each secured in the retaining groove of each of the two side rails of the support frame.

17. The chair in accordance with claim 16, wherein the connector has a mediate portion provided with a plurality of elongated slots located between the two fixing ribs to allow passage of the elastic cords and to limit one of the two opposite ends of the elastic cords.

* * * * *